US010401801B2

(12) United States Patent
Kitamura

(10) Patent No.: US 10,401,801 B2
(45) Date of Patent: Sep. 3, 2019

(54) ELECTRONIC TIMEPIECE, TIME CHANGING METHOD OF ELECTRONIC TIMEPIECE AND STORAGE MEDIUM

(71) Applicant: CASIO COMPUTER CO., LTD., Tokyo (JP)

(72) Inventor: Akira Kitamura, Gunma (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 91 days.

(21) Appl. No.: 15/661,662

(22) Filed: Jul. 27, 2017

(65) Prior Publication Data

US 2018/0074465 A1 Mar. 15, 2018

(30) Foreign Application Priority Data

Sep. 14, 2016 (JP) ..... 2016-179395

(51) Int. Cl.
*G04R 20/26* (2013.01)

(52) U.S. Cl.
CPC ..... *G04R 20/26* (2013.01)

(58) Field of Classification Search
CPC ..... G04B 47/063; G04G 9/00; G04G 9/0064; G04G 9/0005; G04G 11/00; G04R 20/26
See application file for complete search history.

(56) References Cited

U.S. PATENT DOCUMENTS

2015/0378322 A1* 12/2015 Bruins ..... G04R 20/00 368/47
2016/0124394 A1* 5/2016 Hsu ..... G04R 20/26 368/73
2016/0252883 A1* 9/2016 Inoue ..... G04B 47/063 368/11

FOREIGN PATENT DOCUMENTS

CN 204063175 U 12/2014
CN 104777743 A 7/2015
JP 2009-118403 A 5/2009
JP 2011-47727 A 3/2011

OTHER PUBLICATIONS

CNIPA; Application No. 201710652055.4; Office Action dated Jun. 5, 2019.

* cited by examiner

*Primary Examiner* — Sean P Kayes
(74) *Attorney, Agent, or Firm* — Fitch, Even, Tabin & Flannery LLP

(57) ABSTRACT

An electronic timepiece includes a counter, a near field communication unit, a standard electric wave receiving unit and a control unit. The counter is configured to count current time. The near field communication unit is configured to communicate with a terminal by near field communication electric waves and to receive first time information. The standard electric wave receiving unit is configured to receive standard electric waves and to acquire second time information. The control unit changes current time counted by the counter, based on the first or second time information.

10 Claims, 12 Drawing Sheets

ELECTRONIC TIMEPIECE, TIME CHANGING METHOD OF ELECTRONIC TIMEPIECE AND STORAGE MEDIUM

CROSS-REFERENCE TO RELATED APPLICATION

This application is based upon and claims the benefit of priority under 35 USC 119 of Japanese Patent Application No. 2016-179395 filed on Sep. 14, 2016, the entire disclosure of which, including the description, claims, drawings, and abstract, is incorporated herein by reference in its entirety.

BACKGROUND OF THE INVENTION

The present invention relates to an electronic timepiece, a time changing method of the electronic timepiece, and a storage medium.

In the related art, electronic devices capable of exchanging a variety of information by near field communication such as Bluetooth (registered as a trade mark) are known. Especially, in portable electronic devices, each of a plurality of electronic devices can individually acquire and retain information, and use such near field communication to acquire information from other electronic devices. However, in the following sentences, it is not mentioned that Bluetooth is a registered trade mark.

For example, JP-A-2009-118403 discloses a technology for making an electronic watch having a Bluetooth communication function receive time information from a portable phone by Bluetooth communication, thereby correcting the time of the electronic watch.

However, in the electronic watch configuration of JP-A-2009-118403, for example, if a long time elapses after time information is received from the portable phone for some reason, for example, because the portable phone and the electronic watch are in places apart from each other, the time of the electronic watch deviates by the rate of a counter.

Also, if the time of the electronic watch deviates by the rate of the counter, in order to perform a schedule operation of receiving time information from the portable phone at a specific time, the receiving operation should be started early to allow enough time to perform the receiving operation. Therefore, power consumption increases.

SUMMARY OF THE INVENTION

It is therefore an object of the present invention to make it possible for an electronic timepiece to change its own time even in a case where the electronic timepiece cannot perform wireless communication with a terminal and thus time synchronization is impossible.

In order to achieve the above-mentioned object, the present invention an electronic timepiece which includes a counter, a near field communication unit, a standard electric wave receiving unit and a control unit. The counter is configured to count current time. The near field communication unit is configured to communicate with a terminal by near field communication electric waves and to receive first time information. The standard electric wave receiving unit is configured to receive standard electric waves and to acquire second time information. The control unit changes current time counted by the counter, based on the first or second time information.

According to the present invention, it is possible to make it possible for an electronic timepiece to change its own time even in a case where the electronic timepiece cannot perform wireless communication with a terminal and thus time synchronization is impossible.

DETAILED DESCRIPTION

Hereinafter, embodiments of the present invention will be described in detail with reference to the accompanying drawings.

First Embodiment

Figure 1:
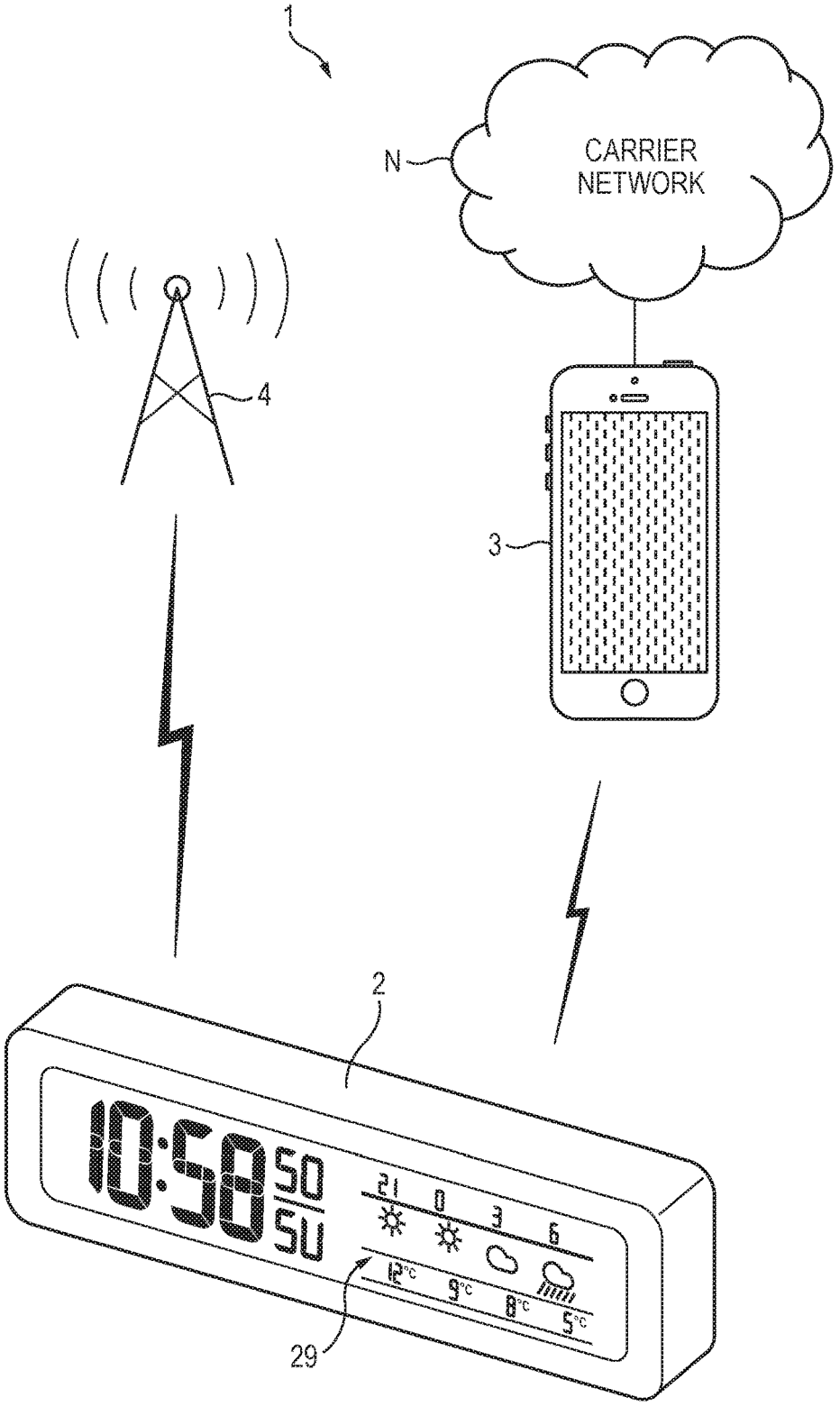
FIG. 1 is a configuration diagram illustrating an overview of a system according to a first embodiment.

FIG. 1 is a configuration diagram illustrating an overview of a system 1 according to a first embodiment.

The system 1 of the first embodiment includes an electronic timepiece 2 and a portable terminal 3.

The electronic timepiece 2 is, for example, a table clock, and changes its own time by accessing the portable terminal 3 using Bluetooth Low Energy and receiving the time of the portable terminal 3 at regular intervals. The electronic timepiece 2 displays a variety of information such as its own time on a display unit 29. Further, the electronic timepiece 2 can receive electric waves of a low frequency band transmitted from standard frequency stations, and demodulate time code outputs (TCOs) of amplitude-modulated standard electric waves, thereby obtaining time codes, and change its own time based on the time codes.

The low frequency band means a frequency band between 30 KHz and 300 KHz in which electric waves have low information transmission capacity, but have low straightness and thus have the property of traveling very far. In contrast, Bluetooth Low Energy uses the 2.4 GHz ISM (Industry Science Medical) band having high straightness to perform communication. Further, Bluetooth Low Energy has appropriately a connection distance between about 2.5 m and about 50 m. In other words, as compared to electric waves of Bluetooth Low Energy, standard electric waves have a longer wavelength, a stronger diffraction property to reach behind an object (a strong wrap-around property), and a wider coverage.

Hereinafter, Bluetooth Low Energy will also be referred to as BLE. Connection using Bluetooth Low Energy will also be referred to as BLE connection.

The portable terminal 3 is, for example, a smart phone, and can perform sound communication and packet communication through a carrier network N. The portable terminal 3 can change its own time information during connection with the carrier network N.

Standard frequency stations 4 mean stations for transmitting standard frequency time signal electric-waves. In Japan, an agent operating standard frequency stations 4 is NYCT (National Institute of Information and Communications Technology), and a call sign is JJY. In Japan, one of the standard frequency stations 4 is installed in Taruma City, Fukushima Prefecture, and transmits standard electric waves having a wavelength of 40 kHz. Another standard frequency station 4 is installed in Saga City, Saga Prefecture, and transmits standard electric waves having a wavelength of 60 kHz.

In the United States, an agent operating a standard frequency station 4 is NIST (National Institute of Standard and Technology), and a call sign for the standard frequency station 4 is WWVB. In the United States, the standard frequency station 4 is installed in Fort Collins, Colo., and transmits standard electric waves having a wavelength of 60 kHz.

In China, an agent operating a standard frequency station 4 is National Time Service Center in Chinese Academy of Sciences, and a call sign for the standard frequency station 4 is BPC. In China, the standard frequency station 4 is installed in Shangqiu City, Henan Province.

In Europe, one standard frequency station 4 is installed in Anthorn, England, and uses MSF as a call sign, and transmits standard electric waves having a frequency of 60 kHz. Another standard frequency station 4 is installed in Mainhausen, Germany, and uses DCF77 as a call sign, and transmits standard electric waves having a frequency of 77.5 kHz.

In the first embodiment, the electronic timepiece 2 is configured to receive standard electric waves between first BLE communication and second BLE communication and change current time which a counter of the electronic timepiece 2 counts. According to this configuration, even in environments and situations in which it is impossible to receive electric waves of BLE, the electronic timepiece 2 can receive standard electric waves having a frequency lower than that of BLE, and change current time. Therefore, it is possible to more accurately hold current time.

When the electronic timepiece 2 capable of performing BLE communication and reception of standard electric waves is not connected to the portable terminal 3, it receives standard electric waves and automatically corrects time. Therefore, the time of the electronic timepiece 2 does not deviate even in a case where the electronic timepiece cannot be connected to the portable terminal 3.

Figure 2:
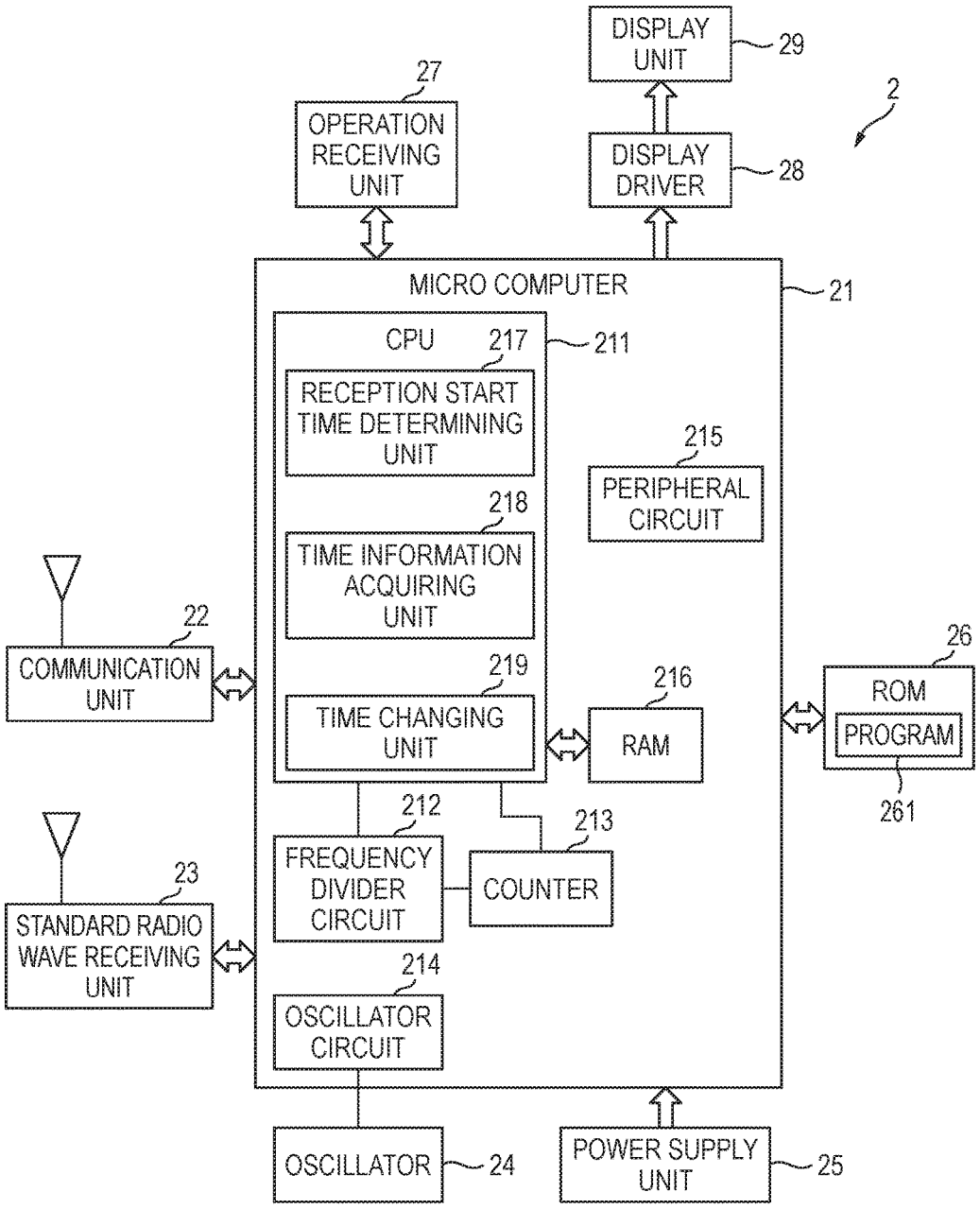
FIG. 2 is a view illustrating an example of the configuration of an electronic timepiece.

FIG. 2 is a view illustrating an example of the configuration of the electronic timepiece 2.

The electronic timepiece 2 is configured such that the display unit 29 configured with liquid crystal can be driven by a display driver 28. The display unit 29 is, for example, a digital character display panel. The electronic timepiece 2 includes a micro computer 21, a communication unit 22, a standard electric wave receiving unit 23, an oscillator 24, a power supply unit 25, a ROM 26, and an operation receiving unit 27, in addition to the display driver 28 and the display unit 29 described above.

The micro computer 21 is for performing various computing processes, thereby generally controlling the electronic timepiece 2, and is configured to include a CPU 211, a frequency divider circuit 212, a counter 213, an oscillator circuit 214, a peripheral circuit 215, and a random access memory (RAM) 216. The CPU 211 of the micro computer 21 executes a program 261 stored in the ROM 26 to be described below, thereby implementing each unit of a reception start time determining unit 217, a time information acquiring unit 218, and a time changing unit 219.

The reception start time determining unit 217 is a unit for determining start times of standard electric wave receiving processes. The reception start time determining unit 217 determines, for example, 2 a.m., 3 a.m., 6 a.m., 10 a.m., 2 p.m., 6 p.m., and 10 p.m., as start times of standard electric wave receiving processes.

The time information acquiring unit 218 is a unit for acquiring time information (second time information) from standard electric waves received by the standard electric wave receiving unit 23.

The time changing unit 219 is a unit for changing current time which is counted by the counter 213, based on time information received from the portable terminal 3 or time information of standard electric waves received by the standard electric wave receiving unit 23.

The RAM 216 is a volatile memory, and is a work area of the CPU 211 for storing variables, data, and so on.

The oscillator circuit 214 generates a unique frequency signal in cooperation with the oscillator 24, and outputs the unique frequency signal to the frequency divider circuit 212. As the oscillator circuit 214, for example, a crystal oscillator circuit can be used.

The frequency divider circuit 212 divides the frequency of the signal input from the oscillator circuit 214, thereby obtaining signals having various frequencies to be used by the CPU 211 and the counter 213, and outputs the obtained signals.

The counter 213 is a counter circuit for counting current time by counting the number of signals with a predetermined frequency input from the frequency divider circuit 212 and adding the count value to an initial time. The current time counted by the counter 213 is read out by the CPU 211 and is used in time display. This time counting may be controlled in a software wise.

The peripheral circuit 215 may be configured to include an additional circuit for receiving input of various sensor signals.

The oscillator 24 is, for example, a crystal oscillator, and generates the unique frequency signal in cooperation with the oscillator circuit 214. The ROM 26 is a non-volatile memory, and is for storing the program 261 to be executed by the CPU 211.

The power supply unit 25 is configured to continuously and stably operate the electronic timepiece 2 for a long period, and is, for example, a combination of a cell battery and a DC to DC converter. Therefore, the output voltage of the power supply unit 25 during an operation is maintained at a predetermined value. Since the electronic timepiece 2 of the first embodiment is a table clock, it can use a battery having sufficient capacity.

The communication unit 22 is a communication channel based on Bluetooth Low Energy, and is a unit for performing information communication with the portable terminal 3. The communication unit 22 transmits and receives near field communication electric waves, specifically, electric waves having a frequency of 2.4 GHz and based on Bluetooth Low Energy. The CPU 211 receives time information (first time information) from the portable terminal 3, and changes the value of the counter 213 based on time codes of the received time information.

The standard electric wave receiving unit 23 is a unit for receiving standard frequency time signal electric-waves (standard electric waves) transmitted from the standard frequency stations 4 (see FIG. 2). Standard electric waves which the standard electric wave receiving unit 23 receives have a stronger diffraction property to reach behind an object than that of near field communication electric waves which the communication unit 22 uses in communication, specifically, electric waves having a frequency of 2.4 GHz and based on Bluetooth Low Energy. The CPU 211 demodulates the time code output (TCO) of each amplitude-modulated standard electric wave, thereby obtaining time information (second time information), and changes the value of the counter 213 based on the time information.

The operation receiving unit 27 is, for example, buttons and the like, and is a unit for receiving user's operations on the electronic timepiece 2.

The display driver 28 controls the display unit 29 configured with liquid crystal such that the display unit performs display based on display control signals input from the micro computer 21. Display examples of the display unit 29 are shown in FIGS. 3 and 4 to be described below.

Figure 3:
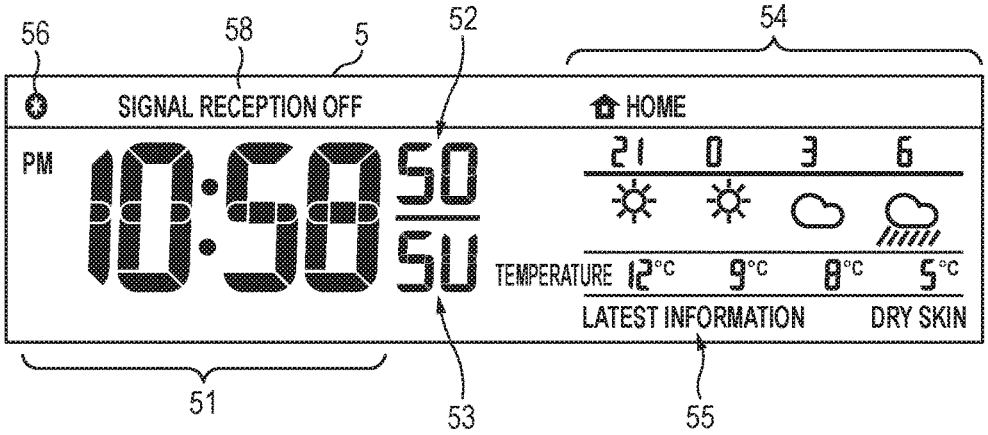
FIG. 3 is a view illustrating a screen example which is displayed when the electronic watch performs near field communication.
Figure 4:
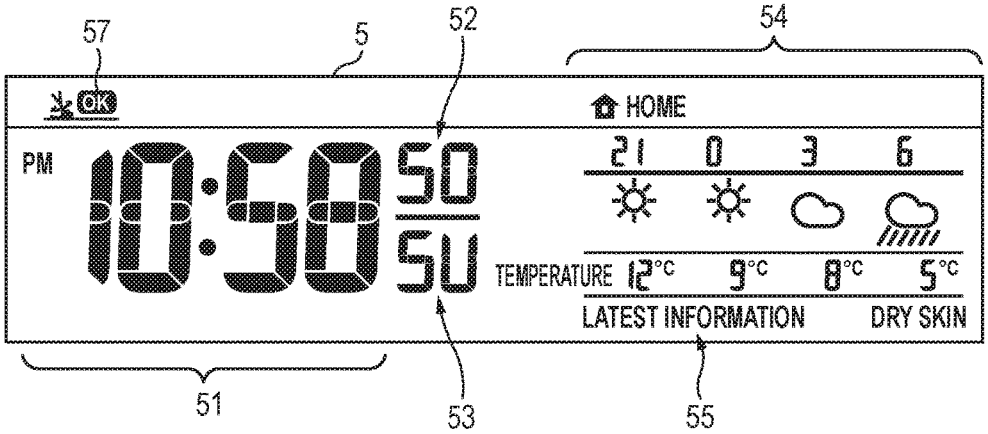
FIG. 4 is a view illustrating a screen example which is displayed when the electronic timepiece receives standard electric waves.

FIG. 3 is a view illustrating an example of a screen 5 which is displayed when the electronic timepiece 2 performs near field communication.

The screen 5 is displayed on the display unit 29. The screen 5 is displayed during near field communication, and includes an hour/minute display section 51, a second display section 52, a day-of-the-week display section 53, a weather forecast display section 54, a latest-information display section 55, a BLE communication icon 56, and a character string "SIGNAL RECEPTION OFF" on the right side of the BLE communication icon.

In the hour/minute display section 51, hour/minute information obtained by clocking of the counter 213 (see FIG. 2) is displayed using seven segment display. In the second display section 52, second information obtained by clocking of the counter 213 (see FIG. 2) is displayed using seven segment display. In the day-of-the-week display section 53, day-of-the-week information obtained by clocking of the counter 213 (see FIG. 2) is displayed using seven segment display. In the weather forecast display section 54, information on weather forecast is displayed with seven-segment numbers and icons.

In the latest-information display section 55, the time of the latest BLE connection and whether the latest BLE connection has succeeded are displayed in response to an operation on the operation receiving unit 27. Specifically, in the latest-information display section 55, the latest information of time information received from the portable terminal 3 is displayed. A user can check whether time synchronization with the portable terminal 3 was correctly performed at a certain time point of the past, based on the latest-information display section 55.

The BLE communication icon 56 is an icon representing that BLE communication (near field communication) is being performed. Based on the BLE communication icon 56, the user can check that time synchronization with the portable terminal 3 is being performed and that the communication unit 22 (see FIG. 2) is operating. A character string "SIGNAL RECEPTION OFF" 58 on the right side of the BLE communication icon 56 shows that reception of standard electric waves is not being performed.

FIG. 4 is a view illustrating an example of a screen 5 which is displayed when the electronic timepiece 2 receives standard electric waves.

In this screen 5, the BLE communication icon 56 and the character string "SIGNAL RECEPTION OFF" 58 shown in FIG. 3 are not displayed, and instead, a standard electric wave reception icon 57 and "OK" representing success in receiving standard electric waves are displayed. Based on the display of the standard electric wave reception icon 57 and "OK", the user can check that a standard electric wave has been received in 24 hours, and that the reception has succeeded.

Figure 5:
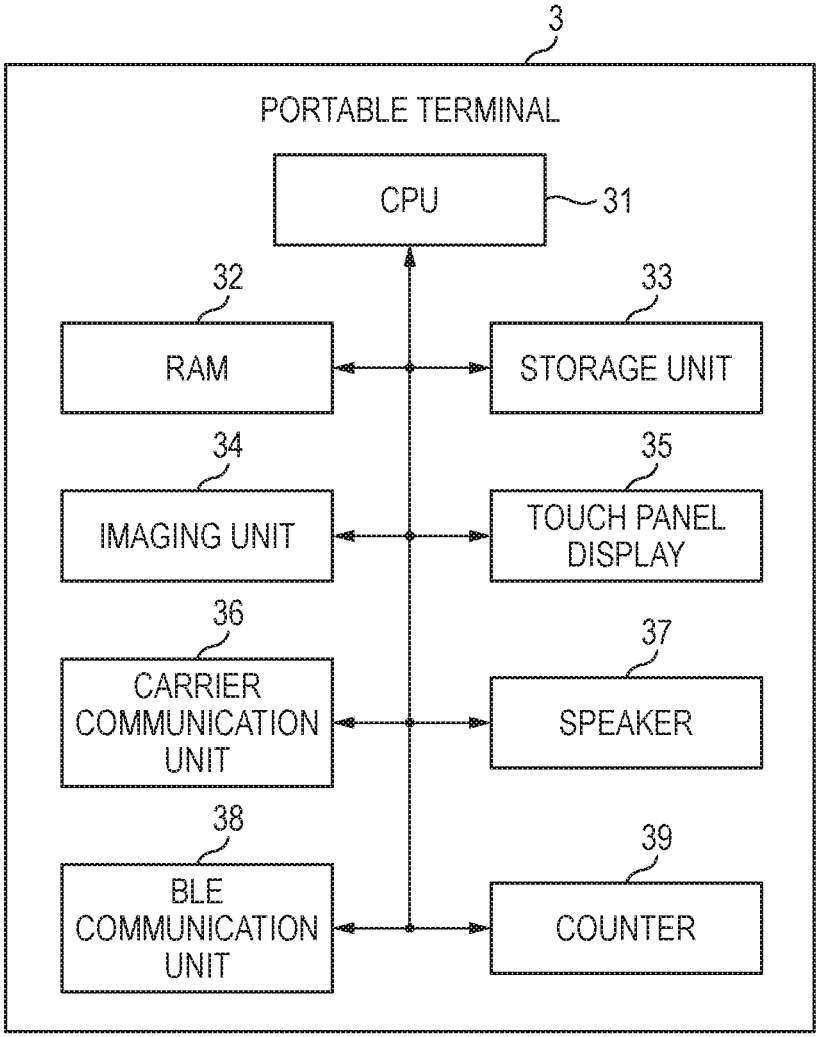
FIG. 5 is a view illustrating an example of the configuration of a portable terminal.

FIG. 5 is a view illustrating an example of the configuration of the portable terminal 3.

In FIG. 5, the portable terminal 3 includes a CPU 31, a RAM 32, a storage unit 33, an imaging unit 34, a touch panel display 35, a carrier communication unit 36, a speaker 37, a BLE communication unit 38, and a counter 39. The individual units of the portable terminal 3 are connected by a bus.

The CPU 31 develops an application program designated from various application programs stored in the storage unit 33 and the like, and various instructions input from the touch panel display 35, in a work memory of the RAM 32. Also, the CPU 31 performs various processes according to the application program developed in the work memory, based on the input instructions and input data, and displays the results of the processes on the touch panel display 35 while storing the process results in the work memory of the RAM 32. Further, the CPU 31 saves the process results stored in the work memory, in a saving destination designated from the touch panel display 35.

The storage unit 33 is configured, for example, with a flash memory and a ROM. The storage unit 33 retains, for example, a program for performing time synchronization with the electronic timepiece 2.

The touch panel display 35 is, for example, a unit configured to have a display function and an input function by stacking a transparent touch panel on a surface of a display panel. The display panel is, for example, a liquid crystal display, an organic EL display, or the like, and has a function of displaying Kanji, Hiragana, and Katakana. The touch panel is a panel for sensing coordinates indicated by an input pen, the tip of a finger, or the like, and detecting the indicated position coordinates by a coordinate reading principle such as an electromagnetic induction type, a magnetostrictive type, or a pressure-sensitive type. The portable terminal 3 generates a signal based on display data input from the CPU 31, and performs a variety of display on the touch panel display 35, and senses indicated coordinates by the touch panel, and outputs the corresponding coordinates to the CPU 31.

The carrier communication unit 36 is configured, for example, with an antenna and a transceiver circuit, and transmits and receives communication data to and from other devices connected to the carrier network N through a radio channel.

The speaker 37 outputs sound information in response to instructions of the CPU 31.

The BLE communication unit 38 is configured, for example, with an antenna and a transceiver circuit, and transmits and receives communication data to and from other devices through a radio channel of Bluetooth Low Energy.

The counter 39 is a counter circuit for counting current time.

Figure 6:
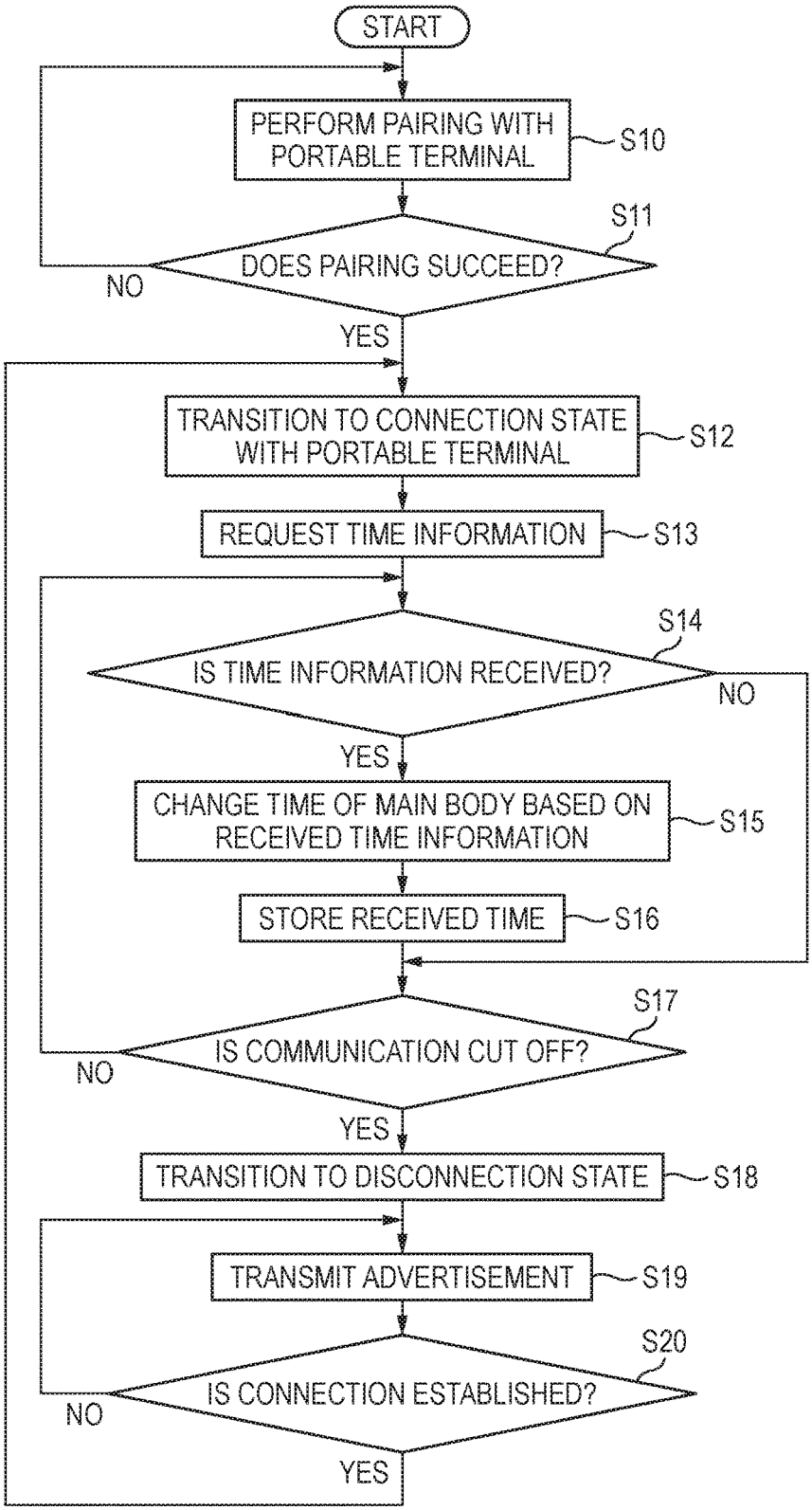
FIG. 6 is a flow chart a near field communication process which is performed by the electronic timepiece.

FIG. 6 is a flow chart illustrating a near field communication process which is performed by the electronic timepiece 2.

First, in STEP S10, the CPU 211 of the electronic timepiece 2 performs pairing with the portable terminal 3 executing a dedicated application program. The CPU 211 tries paring with the portable terminal 3 (STEP S10) if pairing fails ("No" in STEP S11).

If pairing with the portable terminal 3 succeeds ("Yes" in STEP S11), in STEP S12, the electronic timepiece 2 transitions to a connection state with the portable terminal 3.

Subsequently, in STEP S13, the CPU 211 transmits a time information request to the portable terminal 3 by BLE communication. If receiving time information from the portable terminal 3 ("Yes" in STEP S14), the CPU 211 changes the time of the main body based on the received time information in STEP S15, and stores the received time in STEP S16. The CPU 211 repeats the processes of STEPS S13 to S16 if communication has not been cut off ("No" in STEP S17).

Meanwhile, if any time information is not received from the portable terminal 3 ("No" in STEP S14) and communication has not been cut off ("No" in STEP S17), the CPU 211 repeats the process of STEP S14 until communication is cut off.

If communication with the portable terminal 3 is cut off ("Yes" in STEP S17), in STEP S18, the electronic timepiece 2 transitions to a disconnection state. For example, if the distance between the electronic timepiece 2 and the portable terminal 3 increases, communication is cut off. In this case, the CPU 211 transmits an advice to the outside in STEP S19, thereby trying to establish a connection with the portable terminal 3. In a case where a connection has not been established yet ("No" in STEP S20), the CPU 211 repeats advise transmission.

If a connection between the electronic timepiece 2 and the portable terminal 3 is established ("Yes" in STEP S20), the electronic timepiece 2 transitions to the connection state of STEP S12 again. As a result, synchronization of time information restarts.

Figure 7:
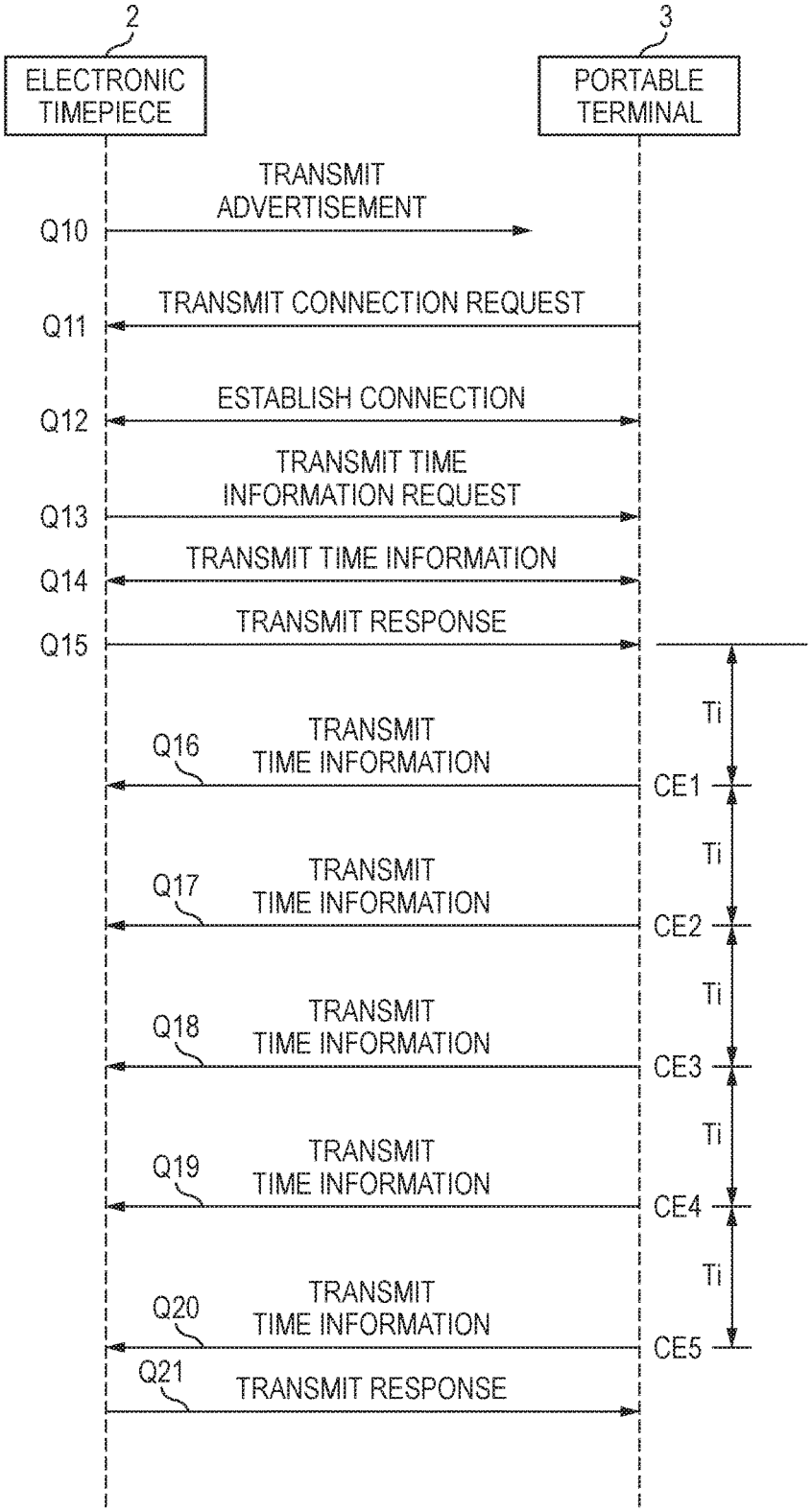
FIG. 7 is a sequence diagram illustrating a near field communication operation which is performed by the electronic timepiece and the portable terminal.

FIG. 7 is a sequence diagram illustrating a near field communication operation which is performed by the electronic timepiece 2 and the portable terminal 3.

First, in SEQUENCE Q10, the electronic timepiece 2 tries to establish a connection with the portable terminal 3 by transmitting an advice to the outside. If the portable terminal 3 receives the advice, in SEQUENCE Q11, the portable terminal transmits a connection request to the electronic timepiece 2. In response to this request, in SEQUENCE Q12, the electronic timepiece 2 establishes a connection with the portable terminal 3. When the connection is established, the electronic timepiece 2 and the portable terminal 3 share the values of individual parameters: connection interval, slave latency, and super-vision timeout.

After the connection is established, in SEQUENCE Q13, the electronic timepiece 2 transmits a time information request command to the portable terminal 3, and in SEQUENCE Q14, the portable terminal 3 transmits time information to the electronic timepiece 2. In SEQUENCE Q15, the electronic timepiece 2 receives the time information transmitted from the portable terminal 3, and transmits a response to the received time information. These operations of SEQUENCES Q13 to Q15 make it possible for the electronic timepiece 2 to perform time synchronization with the portable terminal 3.

Thereafter, in each of connection events (CE1, CE2, CE3, . . . ) which occur at connection intervals Ti, the portable terminal 3 transmits time information in units of packets to the electronic timepiece 2 (SEQUENCES Q16 to Q20).

After the portable terminal 3 transmits the time information in SEQUENCE Q14, while a non-reception period does not exceed a maximum non-reception period, if there is no data required to be notified to the portable terminal 3, the electronic timepiece 2 ignores reception of the time information from the portable terminal 3 in the connection events CE1 and CE2 (SEQUENCES Q16 and Q17).

Then, if the electronic timepiece 2 determines that the non-reception period exceeds the maximum non-reception period in the connection event CE3 (SEQUENCE Q18), it performs only reception of time information from the portable terminal 3, and does not transmit a response to the received time information. Also, based on the time information received from the portable terminal 3, the electronic timepiece 2 performs time synchronization with the portable terminal 3.

Subsequently, in a connection event CE4 (SEQUENCE Q19), the electronic timepiece 2 determines that the non-reception period from the transmission time point of the latest reception data does not exceed the maximum non-reception period, and ignores reception of the data from the portable terminal 3.

Then, in a connection event CE5 (SEQUENCE Q20), the electronic timepiece 2 determines that the number of times transmission of a response to the portable terminal 3 has not been performed exceeds four which is the value of the parameter "slave latency". Therefore, in SEQUENCE Q21, the electronic timepiece 2 receives time information from the portable terminal 3, and transmits a response to the received time information.

Figure 8:
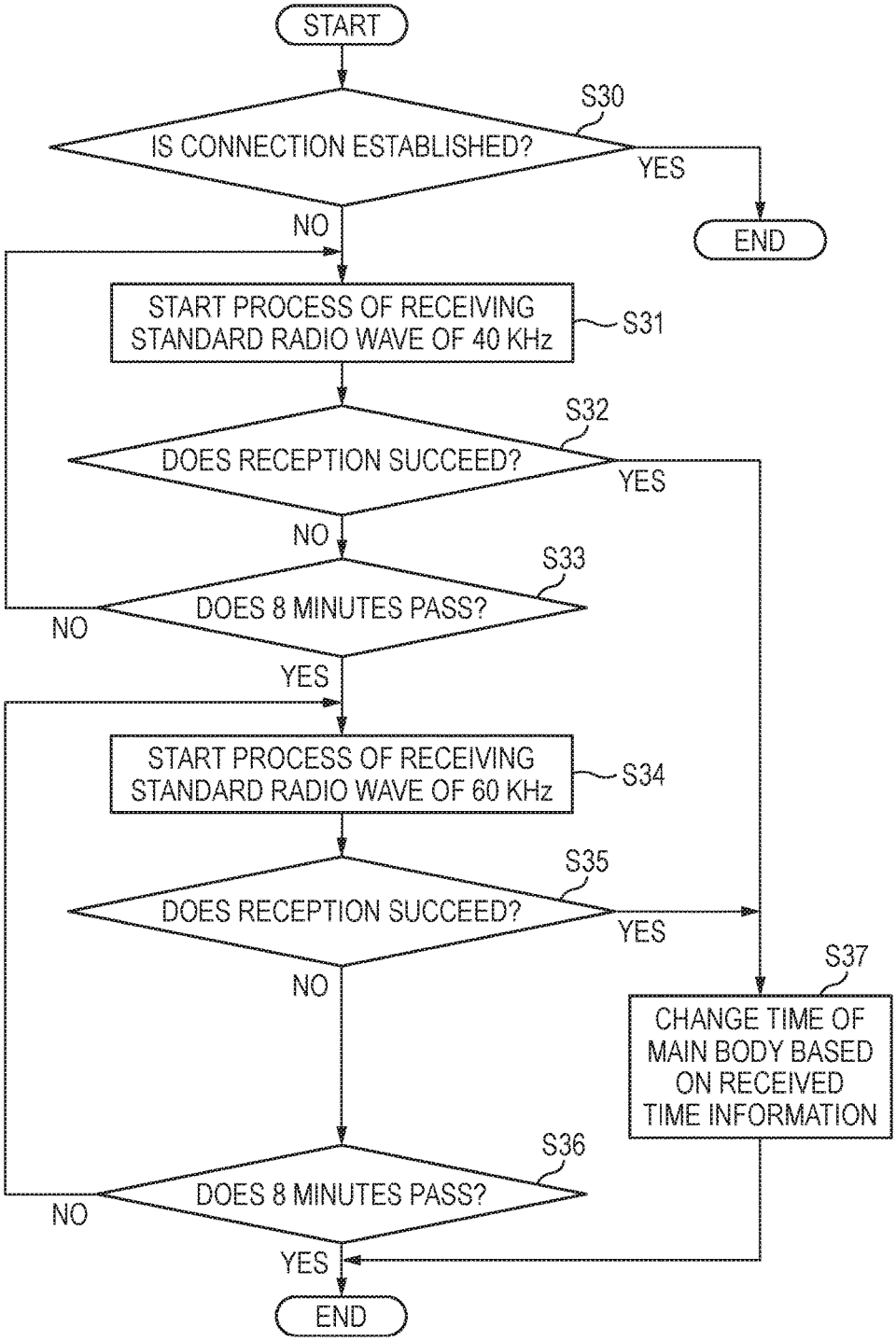
FIG. 8 is a flow chart illustrating a standard electric wave receiving process which is performed by the electronic timepiece.

FIG. 8 is a flow chart illustrating a standard electric wave receiving process which is performed by the electronic timepiece 2.

If predetermined times come, the CPU 211 of the electronic timepiece 2 starts the standard electric wave receiving process. The predetermined times are, for example, 2 a.m., 3 a.m., 6 a.m., 10 a.m., 2 p.m., 6 p.m., and 10 p.m. However, the CPU 211 may start the standard electric wave receiving process in response to a predetermined button operation or the like. Also, the CPU 211 may perform control to switch the standard electric wave receiving unit 23 to a receiving operation, at a time close to midnight than a time to perform control to switch the communication unit 22 to a receiving operation. In this case, the electronic timepiece 2 can perform the standard electric wave receiving process at a time close to midnight when the user is likely to be inactive.

First, if the electronic timepiece 2 has established a connection with the portable terminal 3 using BLE ("Yes" in STEP S30), the CPU 211 finishes the process. If the electronic timepiece 2 has not established a connection with the portable terminal 3 ("No" in STEP S30), in STEP S31, the CPU 211 starts a process of receiving standard electric waves of 40 kHz. As described above, the CPU 211 performs control such that any one of the communication unit 22 and the standard electric wave receiving unit 23 exclusively operates. Hereinafter, the amount of electric current which is consumed once decreases, and stop of the battery due to wasting is prevented.

If reception of standard electric waves of 40 kHz succeeds ("Yes" in STEP S32), the CPU 211 changes the time of the main body based on the received time information, in STEP S37, and finishes this standard electric wave receiving process. Success in receiving standard electric waves means that time code outputs of amplitude-modulated standard electric waves have been demodulated a plurality of times, and those time code outputs have been arranged.

While 8 minutes pass ("No" in STEP S33), the CPU 211 repeats the process of receiving standard electric waves of 40 kHz (STEP S31).

If reception of standard electric waves of 40 kHz has not succeeded ("No" in STEP S32), and 8 minutes have passed ("Yes" in STEP S33), the CPU 211 starts a process of receiving standard electric waves of 60 kHz (STEP S34). This receiving process also takes time.

If reception of standard electric waves of 60 kHz succeeds ("Yes" in STEP S35), the CPU 211 changes the time of the main body based on the received time information, in STEP S37, and finishes this standard electric wave receiving process. Success in receiving standard electric waves means that time code outputs of amplitude-modulated standard electric waves have been demodulated, and those time code outputs have been arranged.

While 8 minutes pass ("No" in STEP S36), the CPU 211 repeats the process of receiving standard electric waves of 60 kHz (STEP S34).

If reception of standard electric waves of 60 kHz has not succeeded ("No" in STEP S35), and 8 minutes have passed ("Yes" in STEP S36), the CPU 211 finishes the process of FIG. 8.

The electronic timepiece 2 of the first embodiment can change its own time by receiving standard electric waves even in a case where the electronic timepiece cannot perform wireless communication with the portable terminal 3 and thus time synchronization is impossible. Further, since only any one of wireless communication with the portable terminal 3 and reception of standard electric waves is exclusively performed, power consumption decreases and wasting of the battery is prevented.

Second Embodiment

While the electronic timepiece 2 of the first embodiment is a table clock, an electronic timepiece 2A of a second embodiment is an analog watch. Hereinafter, the differences from the first embodiment will be mainly described.

Figure 9:
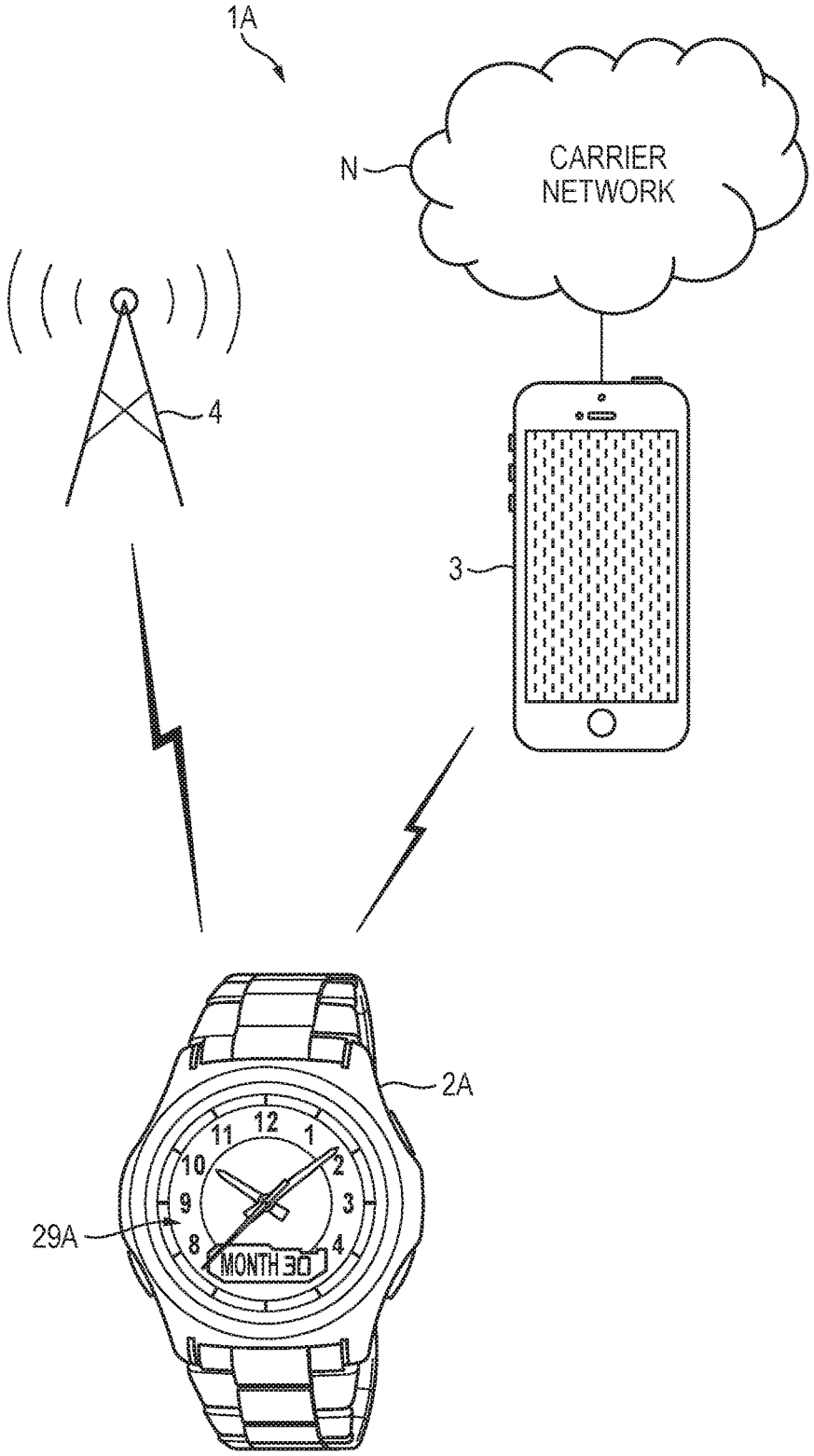
FIG. 9 is a configuration diagram illustrating an overview of a system according to a second embodiment.

FIG. 9 is a configuration diagram illustrating an overview of a system 1A of the second embodiment.

The system 1A of the second embodiment includes the electronic timepiece 2A and a portable terminal 3.

The electronic timepiece 2A is, for example, an analog watch, and changes its own time by accessing the portable terminal 3 using Bluetooth Low Energy and receiving the time of the portable terminal 3 at regular intervals, similarly to the electronic timepiece 2 of the first embodiment. The electronic timepiece 2A displays its own time and the like with hands on a display unit 29A. Further, the electronic timepiece 2A can receive electric waves of a low frequency band transmitted from standard frequency stations, and demodulate time code outputs (TCOs) of amplitude-modulated standard electric waves, thereby obtaining time signals, and change its own time based on the time signals.

Figure 10:
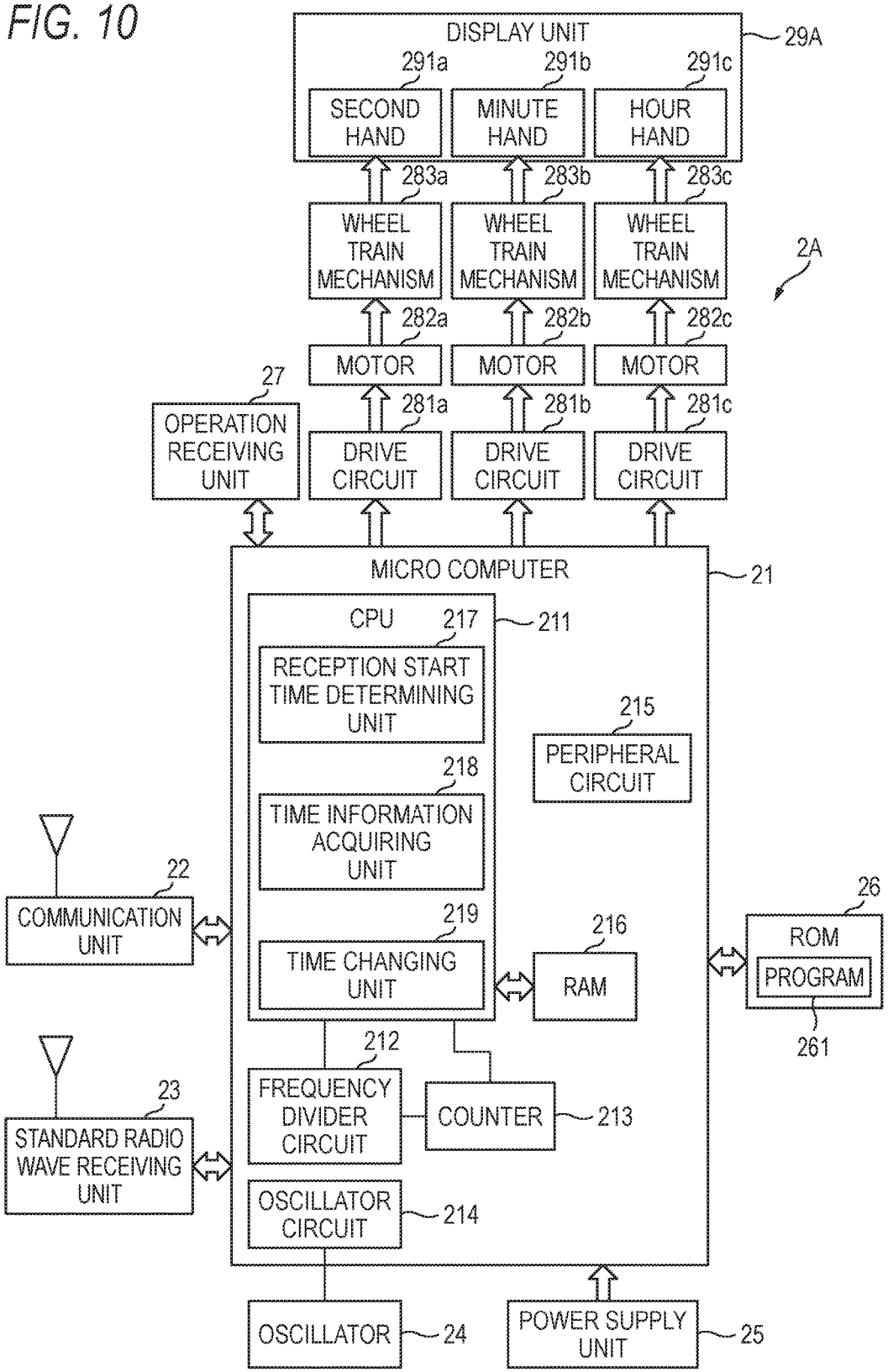
FIG. 10 is a view illustrating an example of the configuration of an electronic timepiece.

FIG. 10 is a view illustrating an example of the configuration of the electronic timepiece 2A.

The electronic timepiece 2A is an analog watch configured such that a second hand 291*a*, a minute hand 291*b*, and an hour hand 291*c* can be driven by stepping motors 282*a* to 282*c* independent from one another, respectively, and having a band for wearing on an arm. The electronic timepiece 2A has the second hand 291*a*, the stepping motor 282*a* for rotating the second hand 291*a* through a wheel chain mechanism 283*a*, and a drive circuit 281*a*. The electronic timepiece 2A has similar configurations with respect to the minute hand 291*b* and the hour hand 291*c*. The second hand 291*a*, the minute hand 291*b*, and the hour hand 291*c* are hands which are displayed on a main dial.

The second hand 291*a*, the minute hand 291*b*, and the hour hand 291*c* can rotate independently from one another. Hereinafter, in a case where the second hand 291*a*, the minute hand 291*b*, and the hour hand 291*c* do not need to be particularly distinguished from one another, they are referred to simply as the hands 291. In a case where wheel chain mechanisms 283*a* to 283*c* do not need to be particularly distinguished from one another, they are referred to simply as the wheel chain mechanisms 283. In a case where the stepping motors 282*a* to 282*c* do not need to be particularly distinguished from one another, they are referred to simply as the stepping motors 282.

The hands 291 are installed so as to be rotatable around a rotor shaft on the dial which is the display unit 29A. The wheel chain mechanisms 283 transmit the driving forces of the individual stepping motors 282 to the hands 291, respectively, thereby rotating the hands 291.

Also, the electronic timepiece 2A of the second embodiment displays that a communication unit 22 is operating or a standard electric wave receiving unit 23 is operating, by the direction indicated by the second hand 291*a*. Therefore, the electronic timepiece 2 can show an operation state using hour/minute/second display or the like, without a dedicated display element.

A power supply unit 25 is configured to continuously and stably operate the electronic timepiece 2A for a long period, and is, for example, a combination of a button battery and a DC to DC converter.

The electronic timepiece 2A has the same configuration as that of the electronic timepiece 2 shown in FIG. 2, except for parts associated with the above-described display unit 29A and the power supply unit 25.

Figure 11:
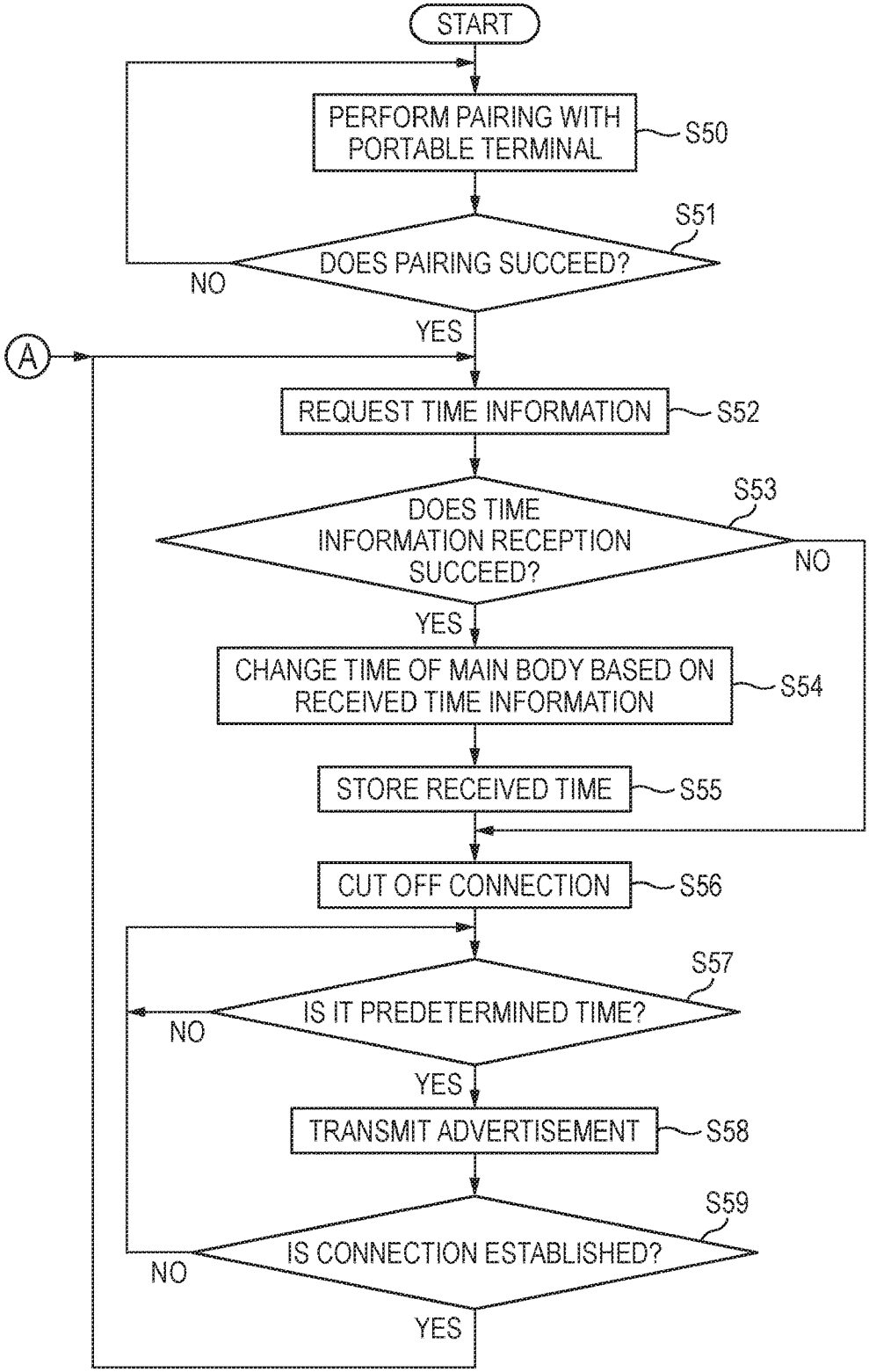
FIG. 11 is a flow chart illustrating a near field communication process which is performed by the electronic timepiece.

FIG. 11 is a flow chart illustrating a near field communication process which is performed by the electronic timepiece 2A.

First, in STEP S50, the CPU 211 of the electronic timepiece 2A performs pairing with the portable terminal 3 executing a dedicated application program. The CPU 211 repeatedly tries paring with the portable terminal 3 (STEP S50) if pairing fails ("No" in STEP S51).

If pairing with the portable terminal 3 succeeds ("Yes" in STEP S51), in STEP S52, the CPU 211 transmits a time information request to the portable terminal 3.

If reception of time information from the portable terminal 3 succeeds ("Yes" in STEP S53), the CPU 211 changes the time of the main body based on the received time information in STEP S54, and stores the received time in STEP S55. Subsequently, in STEP S56, the CPU 211 cuts off the connection with the portable terminal 3.

If reception of time information from the portable terminal 3 fails, ("No" in STEP S53), in STEP S56, the CPU 211 cuts off the connection with the portable terminal 3.

Subsequently, the CPU 211 waits for a predetermined time to come ("No" in STEP S57). The predetermined time is different from a start time of reception of standard electric waves, and is, for example, 7 a.m., 11 a.m., 3 p.m., 7 p.m., or 11 p.m. Therefore, the CPU 211 can perform control such that any one of the communication unit 22 and the standard electric wave receiving unit 23 operates.

If the predetermined time comes ("Yes" in STEP S57), the CPU 211 transmits an advice to the outside in STEP S58, thereby trying to establish a connection with the portable terminal 3. In a case where a connection has not been established ("No" in STEP S59), the CPU 211 returns to the process of STEP S57.

If a connection with the portable terminal 3 is established ("Yes" in STEP S59), the CPU 211 returns to STEP S52 again, and transmits a time information request. As a result, synchronization of time information restarts.

Figure 12:
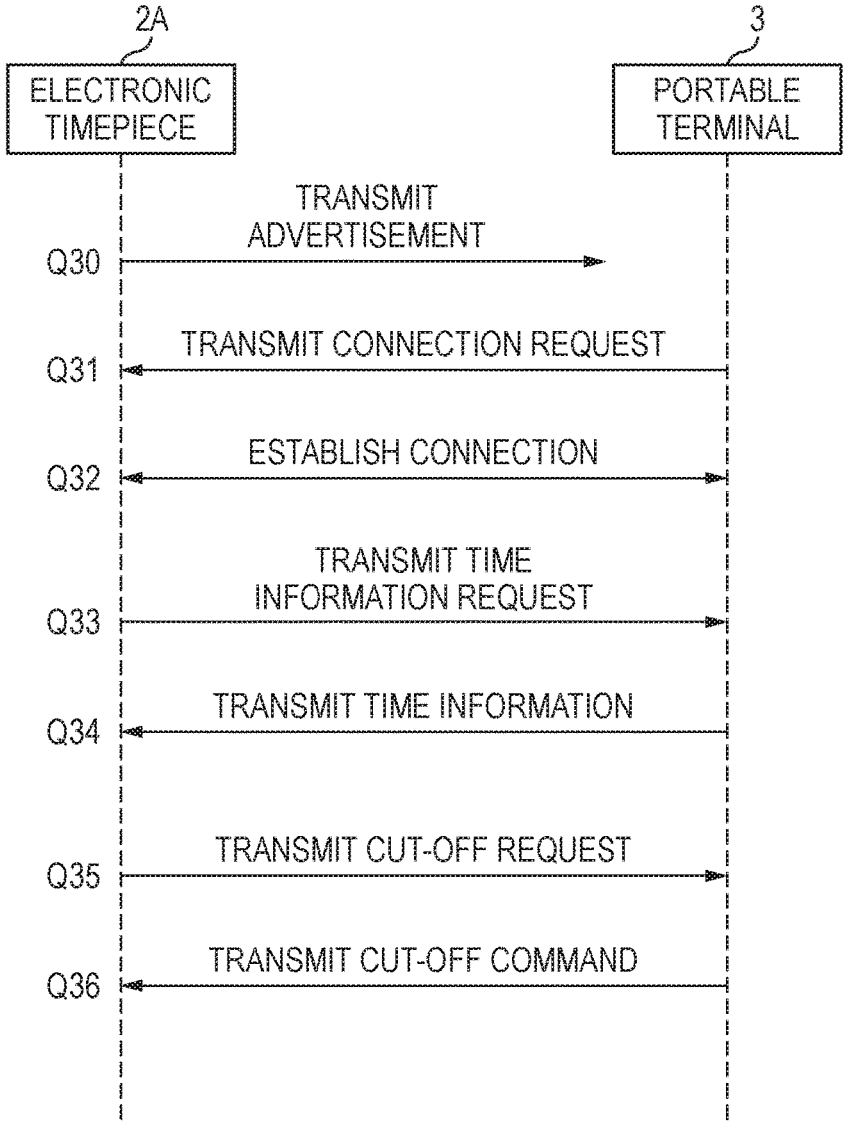
FIG. 12 is a sequence diagram illustrating a near field communication operation which is performed by the electronic timepiece and a portable terminal.

FIG. 12 is a sequence diagram illustrating a near field communication operation which is performed by the electronic timepiece 2A and the portable terminal 3.

First, in SEQUENCE Q30, the electronic timepiece 2A tries to establish a connection with the portable terminal 3 by transmitting an advice to the outside. If the portable terminal 3 receives the advice, in SEQUENCE Q31, the portable terminal transmits a connection request to the electronic timepiece 2A. In response to this request, in SEQUENCE Q32, the electronic timepiece 2A establishes a connection with the portable terminal 3.

After the connection is established, in SEQUENCE Q33, the electronic timepiece 2A transmits a time information request command to the portable terminal 3, and in SEQUENCE Q34, the portable terminal 3 transmits time information to the electronic timepiece 2A.

Subsequently, in SEQUENCE Q35, the electronic timepiece 2A transmits a connection cutoff request command to the portable terminal 3, and in SEQUENCE Q36, the portable terminal 3 transmits a connection cutoff command to the electronic timepiece 2A. This series of operations make it possible for the electronic timepiece 2A to minimize the operation time of the communication unit 22, thereby reducing power consumption of the communication unit 22.

Figure 13:
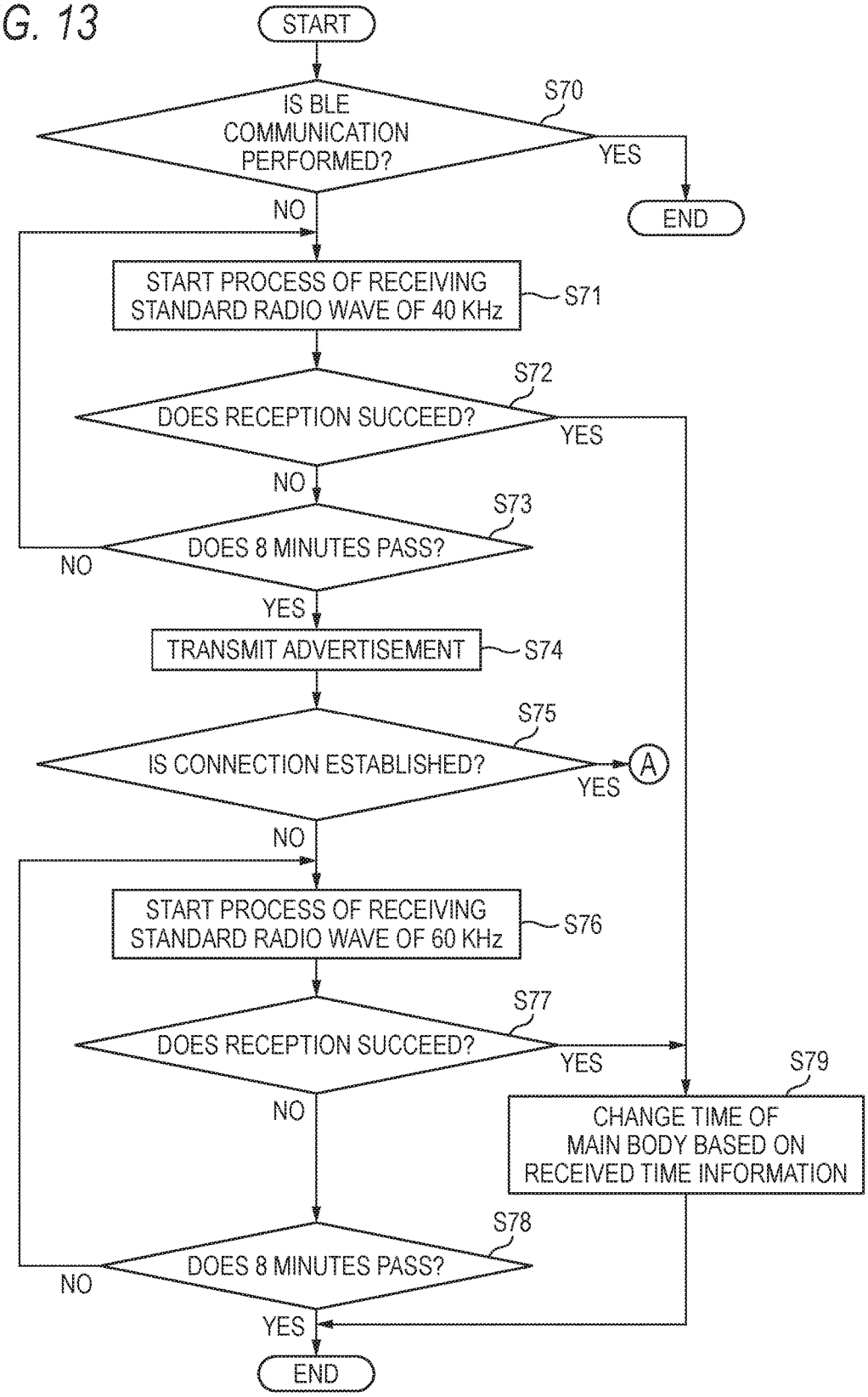
FIG. 13 is a flow chart illustrating a standard electric wave receiving process which is performed by the electronic timepiece.

FIG. 13 is a flow chart illustrating a standard electric wave receiving process which is performed by the electronic timepiece 2A.

If predetermined times come, the CPU 211 of the electronic timepiece 2A starts the standard electric wave receiving process. The predetermined times are, for example, 2 a.m., 3 a.m., 6 a.m., 10 a.m., 2 p.m., 6 p.m., and 10 p.m. However, the CPU 211 may start the standard electric wave receiving process in response to a predetermined button operation or the like. Also, the CPU 211 may perform control to switch the standard electric wave receiving unit 23 to a receiving operation, at a time close to midnight than a time to perform control to switch the communication unit 22 to a receiving operation. In this case, the electronic timepiece 2A can perform the standard electric wave receiving process at a time close to midnight (12 o'clock at night) when the user is likely to be inactive.

First, if the electronic timepiece is performing communication with the portable terminal 3 by BLE ("Yes" in STEP S70), the CPU 211 finishes the process. If the electronic timepiece 2 is not performing communication with the portable terminal 3 ("No" in STEP S70), in STEP S71, the CPU 211 starts a process of receiving standard electric waves of 40 kHz. This receiving process takes time.

If reception of standard electric waves of 40 kHz succeeds ("Yes" in STEP S72), the CPU 211 changes the time of the main body based on the received time information, in STEP S79, and finishes this standard electric wave receiving process. Success in receiving standard electric waves means that time code outputs of amplitude-modulated standard electric waves have been demodulated, and those time code outputs have been arranged.

While 8 minutes pass ("No" in STEP S73), the CPU 211 repeats the process of receiving standard electric waves of 40 kHz (STEP S71).

If reception of standard electric waves of 40 kHz has not succeeded ("No" in STEP S72), and 8 minutes have passed ("Yes" in STEP S73), in STEP S74, the CPU 211 transmits an advice to the outside, thereby trying to establish a connection with the portable terminal 3. If the connection has been established ("Yes" in STEP S75), the CPU 211 proceeds to the process of STEP S52 of FIG. 11, and performs time synchronization with the portable terminal 3. Since time synchronization with the portable terminal 3 finishes in a shorter time as compared to reception of standard electric waves, the electronic timepiece 2A can reduce power consumption according to time changing.

In a case where a connection has not been established yet ("No" in STEP S75), the CPU 211 starts a process of receiving standard electric waves of 60 kHz (STEP S76). This receiving process also takes time.

If reception of standard electric waves of 60 kHz succeeds ("Yes" in STEP S77), the CPU 211 changes the time of the main body based on the received time information, in STEP S79, and finishes this standard electric wave receiving process. Success in receiving standard electric waves means that time code outputs of amplitude-modulated standard electric waves have been demodulated a plurality of times, and those time code outputs have been arranged.

While 8 minutes pass ("No" in STEP S78), the CPU 211 repeats the process of receiving standard electric waves of 60 kHz (STEP S76).

If reception of standard electric waves of 60 kHz has not succeeded ("No" in STEP S77), and 8 minutes have passed ("Yes" in STEP S79), the CPU 211 finishes the process of FIG. 13.

This standard electric wave receiving process makes it possible for the CPU 211 to perform time changing based on standard electric waves even in a case where the electronic timepiece 2A and the portable terminal 3 cannot perform time synchronization.

(Modifications)

The present invention is not limited to the above-described embodiments, and can be modified without departing from the scope of the present invention, and there are, for example, the following modifications (a) to (h).

(a) The present invention may be applied to analog table clocks, digital watches, and wall clocks, but is not limited thereto.

(b) Near field communication of the present invention is not limited to Bluetooth Low Energy, and may be ZigBee (registered as a trade mark), WiFi (registered as a trade mark), and so on.

(c) The present invention is not limited to time synchronization between an electronic timepiece and a portable terminal, and may be configured to perform time synchronization with a fixed terminal such as a desktop computer or a home server.

(d) If time synchronization with the portable terminal 3 was performed in a certain period of the past, each electronic timepiece of the present invention may cancel the standard electric wave receiving process. In this case, it is possible to reduce power consumption of the standard electric wave receiving unit 23.

(e) Each electronic timepiece of the present invention is not limited to a configuration in which the second hand is used to display that the communication unit 22 or the standard electric wave receiving unit 23 is operating, and may be configured to use, for example, a small hand for a chronograph to display the corresponding information.

(f) Each electronic timepiece of the present invention prioritizes time synchronization with the portable terminal 3 over time information of standard electric waves, but may prioritize time information of standard electric waves over time synchronization with the portable terminal 3.

(g) If the electronic timepiece of the first embodiment has received time information of standard electric waves in 24 hours, it displays the standard electric wave reception icon 57 representing that the time information has received. However, when time information of standard electric waves is being received, the electronic timepiece may display an icon or the like representing that the time information is being received.

(h) When the electronic timepiece of the first embodiment performs synchronization with the portable terminal, it displays the BLE communication icon 56 representing that synchronization is being performed. However, if synchronization with the portable terminal has been performed in 24 hours, the electronic timepiece may display an icon or the like representing that synchronization has been performed.

What is claimed is:

1. An electronic timepiece comprising:

a counter that is configured to count current time;

a near field communication unit that is configured to communicate with a terminal by near field communication electric waves and to receive first time information;

a standard electric wave receiving unit that is configured to receive standard electric waves and to acquire second time information; and a control unit, wherein the control unit changes current time counted by the counter, based on the first or second time information, and the control unit controls the electronic timepiece such that one of the near field communication unit and the standard electric wave receiving unit operates exclusively.

2. The electronic timepiece according to claim 1, further comprising:

a display unit that is configured to display that the near field communication unit is operating when the near field communication unit is operating, and to display that the standard electric wave receiving unit is operating when the standard electric wave receiving unit is operating.

3. The electronic timepiece according to claim 1, wherein:

when the near field communication unit is not operating at a predetermined reception start time, the control unit starts a standard electric wave receiving operation of the standard electric wave receiving unit.

4. The electronic timepiece according to claim 3, wherein:

the control unit controls the electronic timepiece such that the near field communication unit starts a communication operation with the terminal at a timing different from the reception start time, and the near field communication unit receives the first time information from the terminal, and the communication between the near field communication unit and the terminal is cut off.

5. The electronic timepiece according to claim 2, wherein:

the control unit controls the electronic timepiece to switch the standard electric wave receiving unit to a receiving operation, at a time closer to midnight than a time to switch the near field communication unit to a receiving operation.

6. The electronic timepiece according to claim 5, wherein:

the near field communication unit maintains a connection state until communication with the terminal is cut off.

7. The electronic timepiece according to claim 6, wherein:

the control unit controls the display unit such that the display unit displays the latest information of the first time information received from the terminal by the near field communication unit.

8. The electronic timepiece according to claim 1, wherein:

the standard electric waves have a stronger diffraction property to reach behind an object than the near field communication electric waves have.

9. A time changing method of an electronic timepiece having a counter configured to count current time, comprising:

receiving first time information from a terminal by near field communication;

acquiring second time information by receiving standard electric waves; and changing current time counted by the counter, based on the first or second time information; and operating one of the receiving of the first time information and the acquiring of the second time information exclusively.

10. A non-transitory computer readable storage medium storing a program for controlling a computer including a counter that is configured to count current time, a near field communication unit that is configured to communicate with a terminal by near field communication electric waves, and a standard electric wave receiving unit that is configured to receive standard electric waves having a stronger diffraction property to reach behind an object than the near field communication electric waves have, to cause the computer to perform operations comprising:

acquiring first time information from the terminal by the near field communication unit;

acquiring second time information based on the standard electric waves received by the standard electric wave receiving unit;

changing current time counted by the counter, based on the first or second time information, and operating one of the acquiring of the first time information and the acquiring of the second time information exclusively.

* * * * *